US008833686B2

(12) United States Patent
Rüther et al.

(10) Patent No.: US 8,833,686 B2
(45) Date of Patent: Sep. 16, 2014

(54) ROLLER MILL FOR COMMINUTING BRITTLE GRINDING STOCK

(75) Inventors: Thomas Rüther, Drensteinfurt (DE); Alexander Peters, Beckum (DE); Ludwig Könning, Ahlen (DE); Nils Hörster, Ennigerloh (DE); Reinhard Giesemann, Harsewinkel (DE)

(73) Assignee: ThyssenKrupp Polysius AG, Beckum (DE)

( * ) Notice: Subject to any disclaimer, the term of this patent is extended or adjusted under 35 U.S.C. 154(b) by 423 days.

(21) Appl. No.: 13/269,758

(22) Filed: Oct. 10, 2011

(65) Prior Publication Data

US 2012/0111982 A1 May 10, 2012

(30) Foreign Application Priority Data

Oct. 14, 2010 (DE) ..... 10 2010 038 197

(51) Int. Cl.
*B02C 4/32* (2006.01)
*B02C 4/02* (2006.01)

(52) U.S. Cl.
CPC .... *B02C 4/32* (2013.01); *B02C 4/02* (2013.01)
USPC ..... 241/227

(58) Field of Classification Search
CPC ..... B02C 4/32; B02C 4/02
USPC ..... 241/227–234
See application file for complete search history.

(56) References Cited

FOREIGN PATENT DOCUMENTS

DE 3635885 C2 5/1988
DE 3825716 A1 * 2/1990

* cited by examiner

*Primary Examiner* — Mark Rosenbaum
(74) *Attorney, Agent, or Firm* — Renner Kenner; Greive Bobak Taylor & Weber

(57) ABSTRACT

A roller mill for comminuting brittle grinding stock comprises at least one grinding roller constructed as a loose roller and rotatable about an axis and interacting with a counter-surface such that grinding stock is comminuted between the grinding roller and counter-surface. Horizontally slidable bearing blocks bear the grinding roller and are guided in a frame rotatably about a vertical bearing axis. A pressing device applies an adjustable grinding pressure to the grinding roller via the bearing blocks. At least two resilient compensation elements are associated with each bearing block in order to compensate a skewed position and/or deflection of the grinding roller. The compensation elements are arranged between the frame and the bearing blocks, and, in the plan view of the roller mill, are arranged tangentially to a circle around the vertical bearing axis or constructed in a circular arc around the vertical bearing axis.

18 Claims, 3 Drawing Sheets

ROLLER MILL FOR COMMINUTING BRITTLE GRINDING STOCK

TECHNICAL FIELD

The invention relates to a roller mill for comminuting brittle grinding stock.

BACKGROUND OF THE INVENTION

The roll crushing mill with two counter-driven grinding rollers pressed against each other is a roller mill frequently used in the comminution of brittle grinding stock. Here, one grinding roller is constructed with a pressing device (loose roller) and the other grinding roller is constructed without a pressing device (fixed roller) and both grinding rollers are mounted in horizontally slidable bearing blocks, wherein at least the loose roller is mounted in horizontally slidable bearing blocks and the bearing blocks are rotatably guided in the machine frame about a bearing axis vertically intersecting the axis of rotation.

In a roll crushing mill with two counter-driven grinding rollers for comminuting brittle materials the two grinding rollers pressed against each other can be mounted in the bearing housing by non-self-aligning cylindrical roller bearings, tapered roller bearings or sliding bearings. In operation of these roll crushing mills, the axis of rotation of the loose roller may be subject to considerable skewing. In the case of non-self-aligning types of bearing, this misalignment may lead to a distortion of the bearing housings of the loose roller in the machine frame.

In addition to the distortion of the bearing housings resulting from the skewed position of the axis of rotation of the loose roller, additional distortion occurs as a result of deflection of the two axes. This deflection leads to a slight distortion of the bearing housings of the fixed roller as well.

In DE 36 35 885 C2, the transmission of force between a pressing device supported in the machine frame and the rotating bearing blocks is ensured by a flat rubber body of plate-like construction. In this way, any skewed positions of a bearing block are absorbed and compensated by the rubber body. The necessary sealing of the rubber body is subject to wear and tear, however, which may lead to failure of the system. In addition, high restoring forces develop, which can lead to damage to the non-adjustable bearings.

The invention therefore addresses the problem of specifying compensation elements for the bearing blocks, which have a long service life and ensure the required mobility with low restoring forces.

SUMMARY OF THE INVENTION

That problem is solved according to the invention by the features of claims 1 and 2.

According to a first exemplary embodiment the roller mill according to the invention for comminuting brittle grinding stock essentially consists of (a) at least one grinding roller rotatable about an axis of rotation, which interacts with a counter-surface in such a manner that the grinding stock is comminuted between grinding roller and counter-surface, wherein at least one grinding roller is constructed as a loose roller, (b) bearing blocks for bearing the grinding roller, wherein the bearing blocks are horizontally slidable and are guided in the machine frame rotatably about a vertical bearing axis intersecting the axis of rotation, (c) a pressing device supported on the machine frame in order to apply an adjustable grinding pressure to the grinding roller via the bearing blocks, and (d) wherein at least two resilient compensation elements are associated with each bearing block in order to compensate a skewed position and/or deflection of the grinding roller, wherein the compensation elements—in the plan view of the roll crushing mill—are arranged tangentially to a circle around the vertical bearing axis and between the machine frame and the bearing blocks.

According to a second embodiment of the invention, the roller mill for comminuting brittle grinding stock essentially consists of (a) at least one grinding roller rotatable about an axis of rotation, which interacts with a counter-surface in such a manner that the grinding stock is comminuted between grinding roller and counter-surface, wherein at least one grinding roller is constructed as a loose roller, (b) bearing blocks for bearing the grinding roller, wherein the bearing blocks are horizontally slidable and are guided in the machine frame rotatably about a vertical bearing axis intersecting the axis of rotation, (c) a pressing device supported on the machine frame in order to apply an adjustable grinding pressure to the grinding roller via the bearing blocks, and (d) wherein at least one resilient compensation element is associated with each bearing block in order to compensate a skewed position and/or deflection of the grinding roller, wherein the at least one compensation element—in the plan view of the roll crushing mill—is constructed in a circular arc around the vertical bearing axis and is arranged between the machine frame and the bearing blocks.

The tangential arrangement of at least two resilient compensation elements per bearing block or the circular arc construction of the compensation element enables the loads on the compensation element and the adjoining components during a rotary movement of the bearing blocks to be considerably reduced, whereby a greater operational reliability of the compensation elements and of the non-self-aligning bearings is achieved.

Further embodiments of the invention form the subject matter of the subsidiary claims.

The roller mill according to the invention covers in particular mills having a fixed or rotating counter-surface, wherein the counter-surface is formed, for example, by a rotating grinding table. A preferred embodiment of the invention, however, concerns a roll crushing mill, in which the counter-surface is formed by a grinding roller in the form of a fixed roller, wherein the grinding stock is comminuted between the two oppositely driven grinding rollers.

Each bearing block may furthermore have a longitudinal median plane, which contains the vertical bearing axis and is aligned perpendicularly to the grinding roller, i.e. perpendicularly to the axis of rotation of the grinding roller. The circular arc-shaped compensation element is then oriented preferably symmetrically with respect to this longitudinal median plane. In the case of a plurality of compensation elements per bearing block, these are likewise arranged symmetrically with respect to this longitudinal median plane.

Furthermore, it is possible for the at least two compensation elements per bearing block to be of straight construction in plan view. In addition, the resilient compensation element can be arranged between the pressing device and bearing block.

According to a preferred exemplary embodiment of the invention, the resilient compensation elements are formed from laminate materials, which, for example, can consist of elastomer layers reinforced with sheet steel. The compensation elements advantageously have a modulus of elasticity of at least 100 $N/mm^2$, preferably of at least 250 $N/mm^2$. The shear modulus of the compensation elements should be at most 10 $N/mm^2$, preferably at most 3 $N/mm^2$.

With these properties, the resilient compensation elements are distinguished by a high compressive strength and high yield to impact. This results in especially low restoring torques when the bearing blocks are skewed. In combination with the tangential arrangement or circular arc-shaped construction of the compensation elements this makes a positive contribution to a long service life of the compensation elements and the non-self-aligning bearings.

BRIEF DESCRIPTION OF THE DRAWINGS

Further advantages and embodiments of the invention are explained in detail hereafter by means of the description and the drawings, in which.

BRIEF DESCRIPTION OF ILLUSTRATIVE EMBODIMENTS

Figure 2:
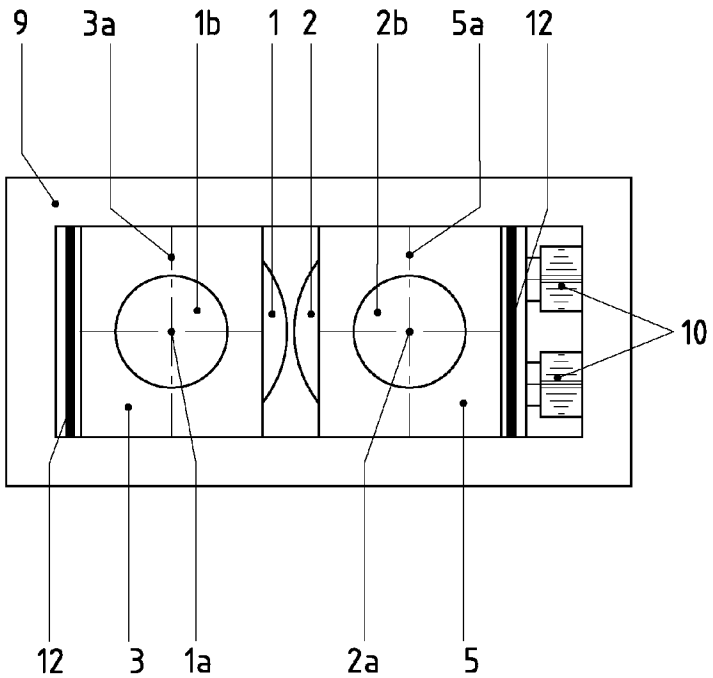
FIG. 2 shows a lateral view of the roller mill according to FIG. 1.
Figure 1:
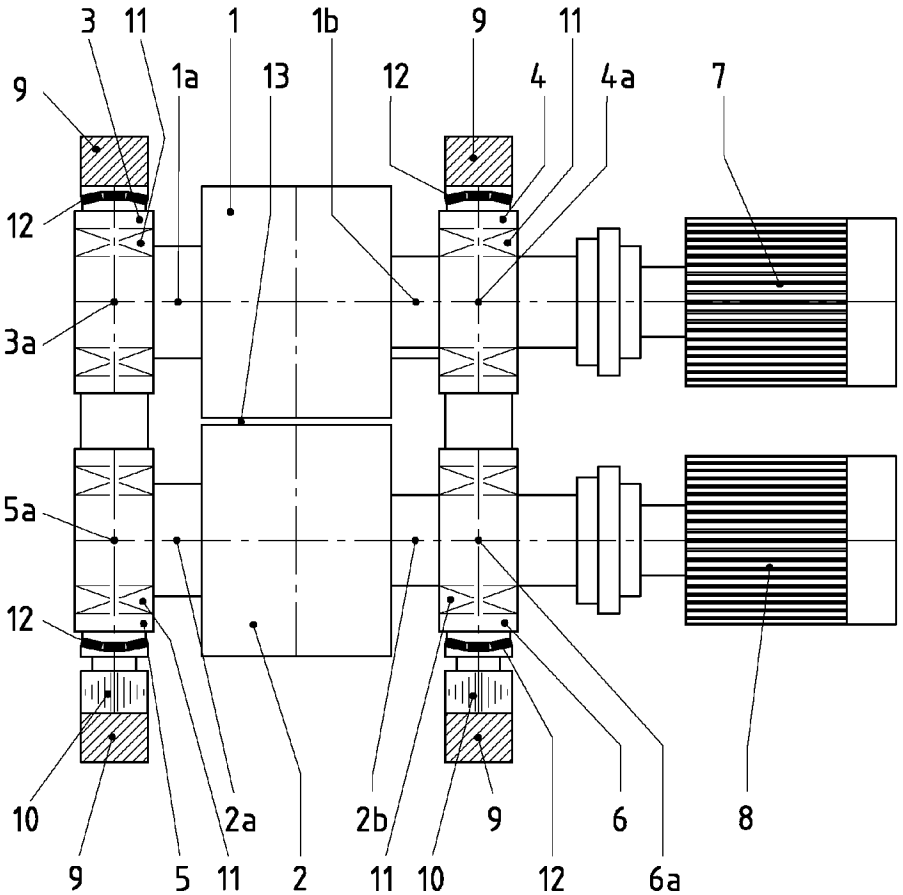
FIG. 1 shows a plan view of a roller mill according to the invention.

The exemplary embodiment according to FIGS. 1 and 2 shows a roller mill in the form of a roll crushing mill having a grinding roller 1 in the form of a loose roller and a grinding roller 2 in the form of a fixed roller, which are mounted so as to rotate with their grinding axes 1*b* and 2*b*, respectively, about axes of rotation 1*a* and 2*a*, respectively, in bearing blocks 3, 4 and 5, 6, respectively. For that purpose, suitable bearings 11, such as, for example, cylindrical roller bearings, tapered roller bearings or sliding bearings, are mounted in the bearing blocks.

The bearing blocks 3 to 6 are horizontally slidable and are rotatably guided in a machine frame 8 about vertical bearing axes 3*a*, 4*a*, 5*a* and 6*a*, respectively, intersecting the axes of rotation 1*a* and 2*a*.

Furthermore, a pressing device 10 supported on the machine frame 9 is provided, in order to apply an adjustable grinding pressure to the grinding rollers via the bearing blocks 5, 6. In addition, at least one resilient compensation element 12 for compensating a skewed position and/or deflection of the grinding rollers is arranged between each of the bearing blocks 3 and 4 and the machine frame 9 and between the pressing device 10 and each of the bearing blocks 5 and 6. As shown in FIG. 1, the compensation elements 12 are arranged—in the plan view of the grinding roll mill—tangentially to a circle about the associated vertical bearing axis 3*a* to 6*a*, as illustrated in detail hereafter by means of FIGS. 3 to 5.

In operation, the grinding rollers 1 and 2 are pressed against each other by the pressing device 10 with a high pressure of, for example, 50 MPa, and are driven in opposite directions by means of drive systems 7 and 8. The grinding stock to be comminuted is drawn into the adjustable nip 12 forming between the two grinding rollers 1 and 2 and is crushed. During operation, skewed positions or deflections of the grinding axes 1*b* and 2*b* may occur, and these skewed positions are transferred to the rotatably mounted bearing blocks 3 to 6. In order to ensure that force is transferred reliably between machine frame 9 or pressing device 10 and the bearing blocks, even when the bearing blocks are skewed, the compensation elements 12 are provided.

The compensation elements 12 are explained in detail hereafter using the example of the bearing block 5. The remarks can be applied correspondingly also to the other bearing blocks 3, 4 and 6.

Figure 3:
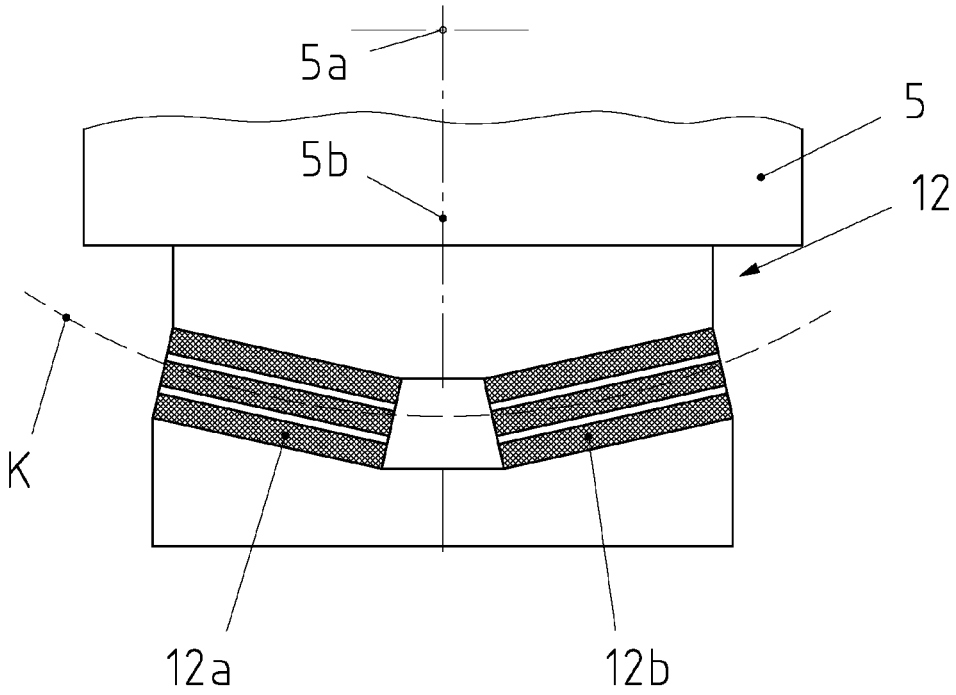
FIG. 3 shows a detail view of a compensation element according to a first exemplary embodiment.

In the first exemplary embodiment illustrated in FIG. 3, two straight compensation elements 12*a*, 12*b* are provided at the bearing block 5, which are arranged tangentially with respect to a circle K around the vertical bearing axis 5*a*. Furthermore, the two compensation elements 12*a*, 12*b* are oriented symmetrically with respect to the longitudinal median plane 5*b*, said longitudinal median plane 5*b* containing the vertical bearing axis 5*a* and being aligned perpendicularly to the axis of rotation 2*a*.

Within the scope of the invention, it is also possible, however, for more than two such compensation elements to be provided. In the exemplary embodiment according to FIG. 5, three such compensation elements 12*c* to 12*e* are shown, which in turn are arranged tangentially with respect to the circle K around the vertical bearing axis 5*a* and symmetrically with respect to the longitudinal median plane 5*b*.

Figure 4:
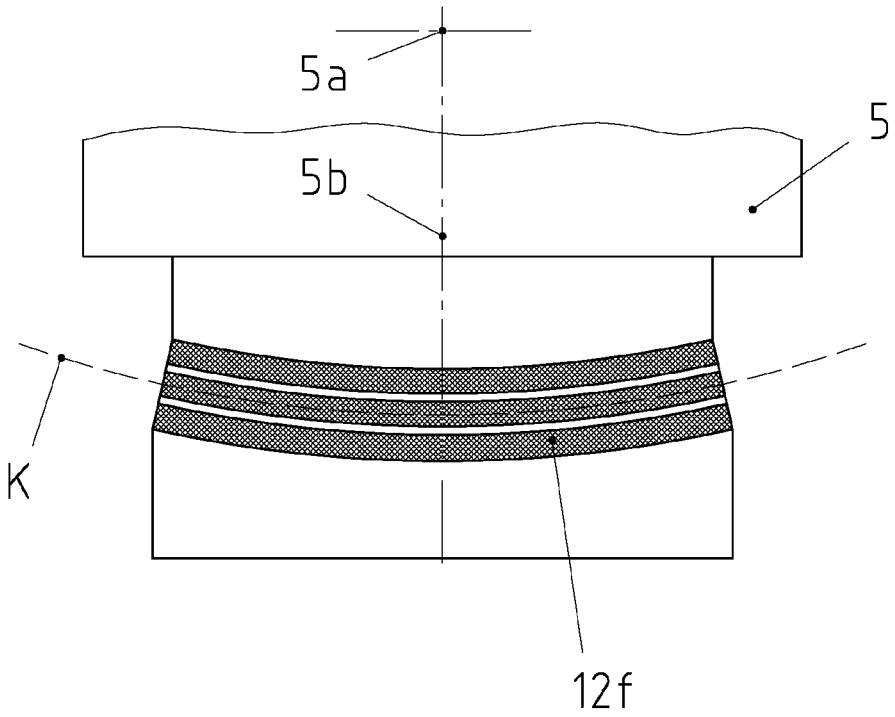
FIG. 4 shows a detail view of a compensation element according to a second exemplary embodiment.
Figure 5:
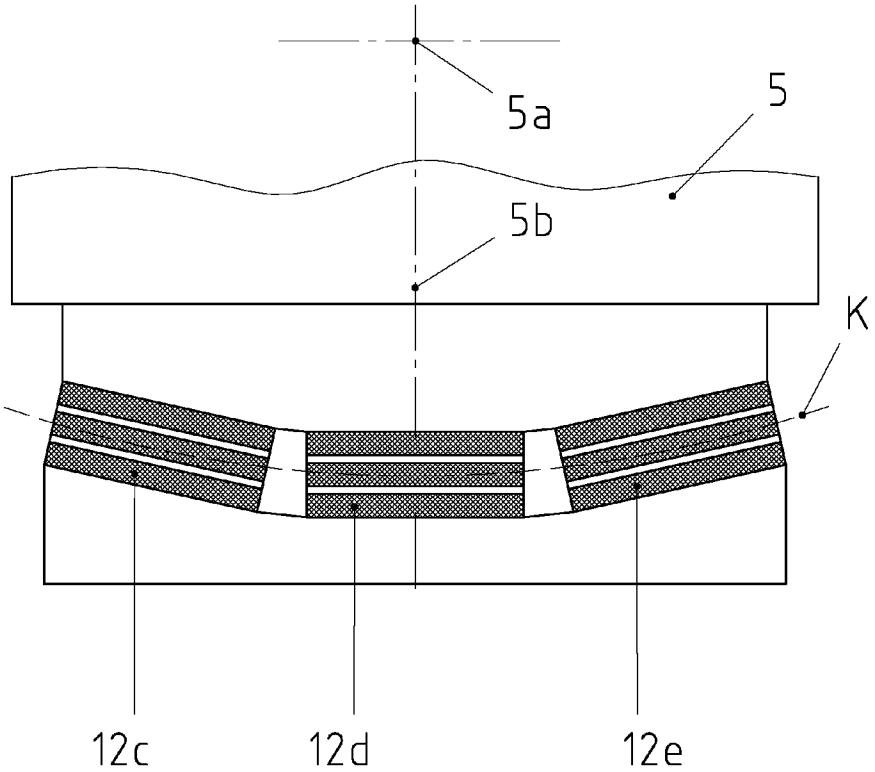
FIG. 5 shows a detail view of a compensation element according to a third exemplary embodiment.

Whereas the compensation elements in the examples according to FIGS. 3 and 5 are straight, in the exemplary embodiment according to FIG. 4 a compensation element 12*f* of circular arc-shaped construction is used, which is arranged on the circle K about the vertical bearing axis 5*a*. Alternatively, of course, two, three or more circular arc-shaped compensation elements can be provided.

The compensation elements 12*a* to 12*f* consist, for example, of laminate materials, such as, for example, elastomer layers reinforced with sheet steel.

During the trials on which the invention is based, it proved especially advantageous for the resilient compensation elements to have a modulus of elasticity of at least 100 $N/mm^2$, preferably of at least 250 $N/mm^2$, and a shear modulus of at most 10 $N/mm^2$, preferably at most 3 $N/mm^2$.

Such compensation elements are distinguished by low restoring torques during radial deflection and by a high compressive strength.

Figure 6:
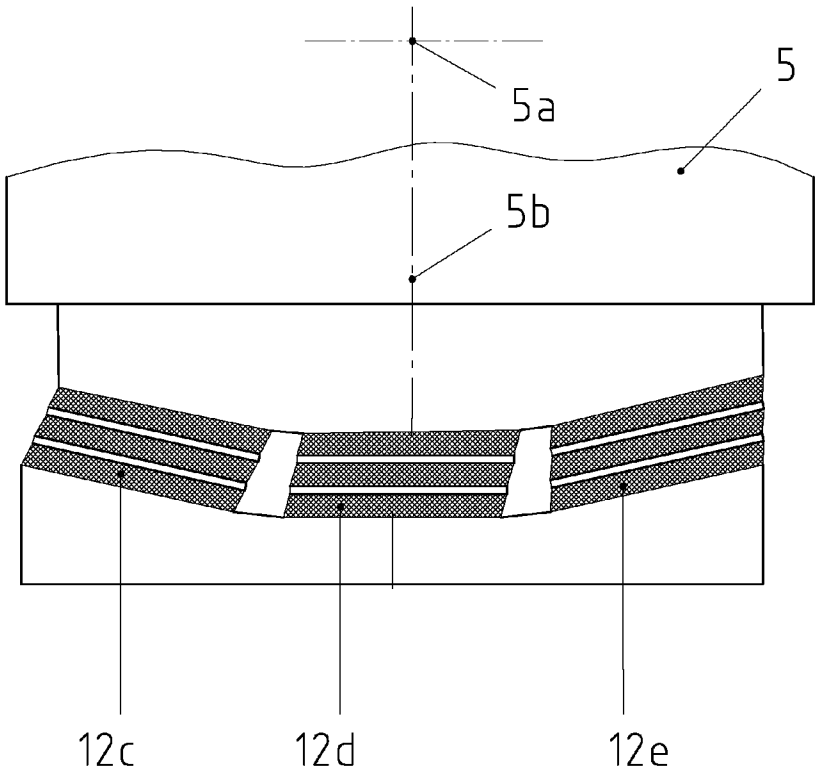
FIG. 6 shows a detail view of the compensation element according to FIG. 5 in a rotated position of the bearing block.

FIG. 6 shows the situation during a skewed position of the bearing block 5. Because of the tangential arrangement, the bearing block is able to rotate about its vertical bearing axis 5*a* without tilting or a heavily one-sided loading of the compensation elements 12*c*, 12*d* and 12*e* occurring.

The tangential arrangement or circular arc-shaped construction of the compensation elements causes predominantly a stress based on thrust when the bearing blocks rotate. This thrust stress can be accommodated by elastomers without great reaction forces. It is thus possible to minimise the reaction forces on the non-self-aligning cylindrical roller bearings, tapered roller bearings or sliding bearings. The roller bearings then have lower edge loads and an increased service life and the sliding bearing can be constructed to be more reliable in operation.

The invention claimed is:

1. A roller mill for comminuting brittle grinding stock, having a) at least one grinding roller rotatable about an axis of rotation, which interacts with a counter-surface in such a manner that the grinding stock is comminuted between grinding roller and counter-surface, wherein at least one grinding roller is constructed as a loose roller, b) bearing blocks for bearing the grinding roller, wherein the bearing blocks are horizontally slidable and are guided in the machine frame rotatably about a vertical bearing axis intersecting the axis of rotation, c) a pressing device supported on the machine frame in order to apply an adjustable grinding pressure to the grinding roller via the bearing blocks, and d) wherein at least one resilient compensation element is associated with each bearing block in order to compensate a skewed position and/or deflection of the grinding roller, wherein the at least one compensation element—in the plan view of the roll crushing mill—is constructed in a circular arc around the vertical bearing axis and is arranged between the machine frame and the bearing blocks.

2. A roller mill for comminuting brittle grinding stock, having a) at least one grinding roller rotatable about an axis of rotation, which interacts with a counter-surface in such a manner that the grinding stock is comminuted between grinding roller and counter-surface, wherein at least one grinding roller is constructed as a loose roller, b) bearing blocks for bearing the grinding roller, wherein the bearing blocks are horizontally slidable and are guided in the machine frame rotatably about a vertical bearing axis intersecting the axis of rotation, c) a pressing device supported on the machine frame in order to apply an adjustable grinding pressure to the grinding roller via the bearing blocks, and wherein at least two resilient compensation elements are associated with each bearing block in order to compensate a skewed position and/or deflection of the grinding roller, wherein the compensation elements—in the plan view of the roll crushing mill—are constructed in a circular arc around the vertical bearing axis and are arranged tangentially to a circle around the vertical bearing axis and between the machine frame and the bearing blocks.

3. The roller mill according to claim 1, characterised in that the counter-surface is formed by a grinding roller in the form of a fixed roller, wherein the grinding stock is comminuted between the two oppositely driven grinding rollers.

4. A roller mill according to claim 1, characterised in that each bearing block has a longitudinal median plane, which contains the vertical bearing axis and is aligned perpendicularly to the axis of rotation and the at least one resilient compensation element is oriented preferably symmetrically with respect to said longitudinal median plane.

5. A roller mill according to claim 1, characterised in that the compensation elements are of straight construction in plan view.

6. A roller mill according to claim 1, characterised in that the resilient compensation elements are arranged between the pressing device and bearing block.

7. A roller mill according to claim 1, characterised in that the resilient compensation elements are formed from laminate materials.

8. A roller mill according to claim 1, characterised in that the resilient compensation elements consist of elastomer layers reinforced with sheet steel.

9. A roller mill according to claim 1, characterised in that the resilient compensation elements have a modulus of elasticity of at least 100 $N/mm^2$.

10. A roller mill according to claim 1, characterised in that the resilient compensation elements have a shear modulus of at most 10 $N/mm^2$.

11. The roller mill according to claim 2, characterised in that the counter-surface is formed by a grinding roller in the form of a fixed roller, wherein the grinding stock is comminuted between the two oppositely driven grinding rollers.

12. A roller mill according to claim 2, characterised in that each bearing block has a longitudinal median plane, which contains the vertical bearing axis and is aligned perpendicularly to the axis of rotation and the at least one resilient compensation element is oriented preferably symmetrically with respect to said longitudinal median plane.

13. A roller mill for comminuting brittle grinding stock, having a) at least one grinding roller rotatable about an axis of rotation, which interacts with a counter-surface in such a manner that the grinding stock is comminuted between grinding roller and counter-surface, wherein at least one grinding roller is constructed as a loose roller, b) bearing blocks for bearing the grinding roller, wherein the bearing blocks are horizontally slidable and are guided in the machine frame rotatably about a vertical bearing axis intersecting the axis of rotation, c) a pressing device supported on the machine frame in order to apply an adjustable grinding pressure to the grinding roller via the bearing blocks, and wherein at least two resilient compensation elements are associated with each bearing block in order to compensate a skewed position and/or deflection of the grinding roller, wherein the compensation elements—in the plan view of the roll crushing mill—are of straight construction in plain view and are arranged tangentially to a circle around the vertical bearing axis and between the machine frame and the bearing blocks.

14. A roller mill according to claim 2, characterised in that the resilient compensation elements are arranged between the pressing device and bearing block.

15. A roller mill according to claim 2, characterised in that the resilient compensation elements are formed from laminate materials.

16. A roller mill according to claim 2, characterised in that the resilient compensation elements consist of elastomer layers reinforced with sheet steel.

17. A roller mill according to claim 2, characterised in that the resilient compensation elements have a modulus of elasticity of at least 100 $N/mm^2$.

18. A roller mill according to claim 2, characterised in that the resilient compensation elements have a shear modulus of at most 10 $N/mm^2$.

* * * * *